US009989047B2

(12) United States Patent
Chen et al.

(10) Patent No.: US 9,989,047 B2
(45) Date of Patent: Jun. 5, 2018

(54) MICRO-GAS PRESSURE DRIVING DEVICE

(71) Applicant: MICROJET TECHNOLOGY CO., LTD., Hsinchu (TW)

(72) Inventors: Shih-Chang Chen, Hsinchu (TW); Jia-Yu Liao, Hsinchu (TW); Cheng-Tse Kuo, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 328 days.

(21) Appl. No.: 14/823,060

(22) Filed: Aug. 11, 2015

(65) Prior Publication Data

US 2016/0076530 A1 Mar. 17, 2016

(30) Foreign Application Priority Data

Sep. 15, 2014 (TW) ..... 103131689 A

(51) Int. Cl.

| | |
|---|---|
| ***F04B 17/03*** | (2006.01) |
| ***F04B 43/04*** | (2006.01) |
| ***F04B 53/16*** | (2006.01) |
| ***F04B 45/047*** | (2006.01) |

(52) U.S. Cl.

CPC ..... *F04B 43/046* (2013.01); *F04B 45/047* (2013.01); *F04B 53/16* (2013.01)

(58) Field of Classification Search

CPC ..... F04B 43/046; F04B 45/047; F04B 53/16
See application file for complete search history.

(56) References Cited

U.S. PATENT DOCUMENTS

| | | | | |
|---|---|---|---|---|
| 4,687,423 | A * | 8/1987 | Maget | A61M 5/14276 417/379 |
| 5,094,594 | A * | 3/1992 | Brennan | F04B 43/046 417/413.2 |
| 5,171,132 | A * | 12/1992 | Miyazaki | F04B 43/046 417/322 |
| 8,523,538 | B2 * | 9/2013 | Kawamura | F04B 43/046 417/413.1 |

(Continued)

FOREIGN PATENT DOCUMENTS

| | | |
|---|---|---|
| TW | 201239225 | 10/2012 |
| TW | M467740 | 12/2013 |

*Primary Examiner* — Charles Freay

(74) *Attorney, Agent, or Firm* — Kirton McConkie; Evan R. Witt

(57) ABSTRACT

A micro-gas pressure driving device includes a miniature gas transportation module, a covering plate and a tube plate. The miniature gas transportation module includes a convergence plate, a resonance membrane and a piezoelectric actuator. When the piezoelectric actuator is activated to feed a gas into an input tube of the tube plate, the gas is sequentially transferred through a first input chamber, a second input chamber, an inlet, a convergence channel and a central opening of the convergence plate, a central aperture of the resonance membrane, and transferred downwardly through the piezoelectric actuator and an output chamber, and outputted from an output tube of the tube plate. The first input chamber is arranged between the covering plate and the input tube. The second input chamber is defined between the covering plate and the convergence plate. The output chamber is defined between the tube plate and the piezoelectric actuator.

9 Claims, 12 Drawing Sheets

(56) References Cited

U.S. PATENT DOCUMENTS

| | | | | |
|---|---|---|---|---|
| 8,596,998 | B2 * | 12/2013 | Fujisaki | F04B 45/047 417/413.1 |
| 8,721,303 | B2 * | 5/2014 | Fujisaki | F04B 43/046 417/413.2 |
| 9,360,003 | B2 * | 6/2016 | Oerter | A61M 1/1053 |
| 9,611,843 | B2 * | 4/2017 | Hsueh | F04B 43/046 |
| 2004/0265150 | A1 * | 12/2004 | McElfresh | B81B 3/0035 417/413.1 |
| 2009/0243431 | A1 * | 10/2009 | Ohsawa | F04B 43/046 310/317 |
| 2011/0006127 | A1 * | 1/2011 | Ono | A61B 17/3203 239/1 |
| 2012/0085949 | A1 | 4/2012 | Chen et al. | |

* cited by examiner

MICRO-GAS PRESSURE DRIVING DEVICE

FIELD OF THE INVENTION

The present invention relates to a pressure driving device, and more particularly to a slim and silent micro-gas pressure driving device.

BACKGROUND OF THE INVENTION

With the advancement of science and technology, fluid transportation devices used in many sectors such as pharmaceutical industries, computer techniques, printing industries or energy industries are developed toward elaboration and miniaturization. The fluid transportation devices are important components that are used in for example micro pumps, micro atomizers, printheads or industrial printers. Therefore, it is important to provide an improved structure of the fluid transportation device.

For example, in the pharmaceutical industries, pressure driving devices or pressure driving machines use motors or pressure valves to transfer gases. However, due to the volume limitations of the motors and the pressure valves, the pressure driving devices or the pressure driving machines are bulky in volume. In other words, the conventional pressure driving device fails to meet the miniaturization requirement and is not portable. Moreover, during operations of the motor or the pressure valve, annoying noise is readily generated. That is, the conventional pressure driving device is neither friendly nor comfortable to the user.

Therefore, there is a need of providing a micro-gas pressure driving device with small, miniature, silent, portable and comfortable benefits in order to eliminate the above drawbacks.

SUMMARY OF THE INVENTION

The present invention provides a micro-gas pressure driving device for a portable or wearable equipment or machine. When a piezoelectric actuator is activated, a pressure gradient is generated in the fluid channels of a miniature gas transportation module to facilitate the gas to flow at a high speed. Moreover, since there is an impedance difference between the feeding direction and the exiting direction, the gas can be transmitted from the inlet side to the outlet side. Moreover, even if the outlet side has a gas pressure, the miniature gas transportation module still has the capability of pushing out the gas.

In accordance with an aspect of the present invention, there is provided a micro-gas pressure driving device. The micro-gas pressure driving device includes a miniature gas transportation module, a covering plate and a tube plate. The miniature gas transportation module includes a convergence plate, a resonance membrane and a piezoelectric actuator. At least one inlet is formed in a first surface of the convergence plate. At least one convergence channel and a central opening are formed in a second surface of the convergence plate. The at least one convergence channel is in communication with the at least one inlet. The resonance membrane has a central aperture corresponding to the central opening of the convergence plate. The convergence plate, the resonance membrane and the piezoelectric actuator are stacked on each other sequentially. The covering plate is disposed over the convergence plate of the miniature gas transportation module. The tube plate is disposed under the piezoelectric actuator of the miniature gas transportation module, and includes an input tube and an output tube. After the covering plate, the miniature gas transportation module and the tube plate are combined together, a first input chamber is located at a junction between the covering plate and the input tube of the tube plate, a second input chamber is defined between the covering plate and the convergence plate of the miniature gas transportation module, and an output chamber is defined between the tube plate and the piezoelectric actuator of the miniature gas transportation module. When the miniature gas transportation module is activated to feed a gas into the input tube of the tube plate, the gas is sequentially transferred through the first input chamber, the second input chamber, the at least one inlet of the convergence plate, the at least one convergence channel of the convergence plate, the central opening of the convergence plate and the central aperture of the resonance membrane, and transferred downwardly through the piezoelectric actuator and the output chamber, and outputted from the output tube of the tube plate.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a micro-gas pressure driving device. The micro-gas pressure driving device may be used in many sectors such as pharmaceutical industries, energy industries, computer techniques or printing industries for transporting gases.

Figure 1A:
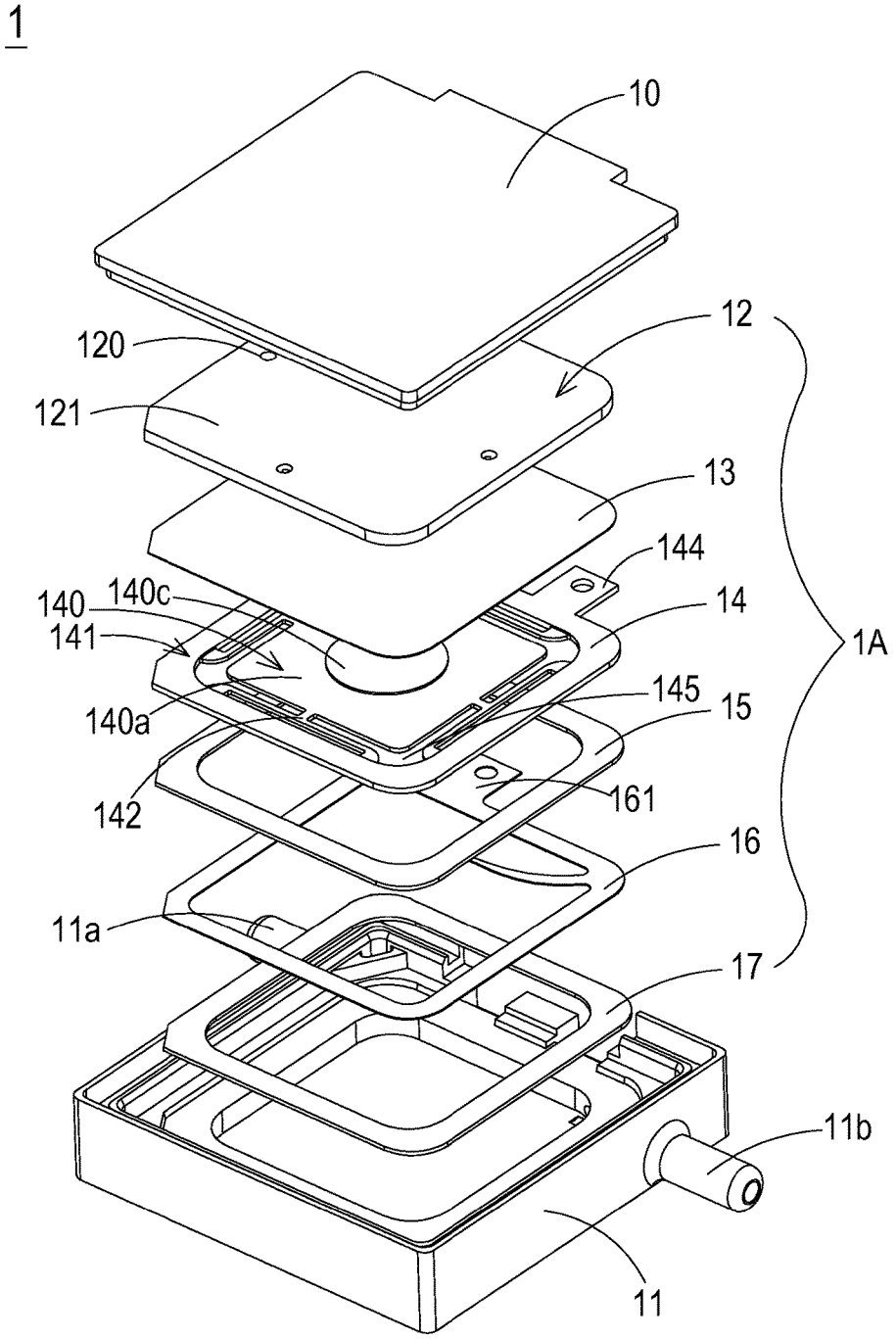
FIG. 1A is a schematic exploded view illustrating a micro-gas pressure driving device according to a first embodiment of the present invention and taken along a front side.
Figure 1B:
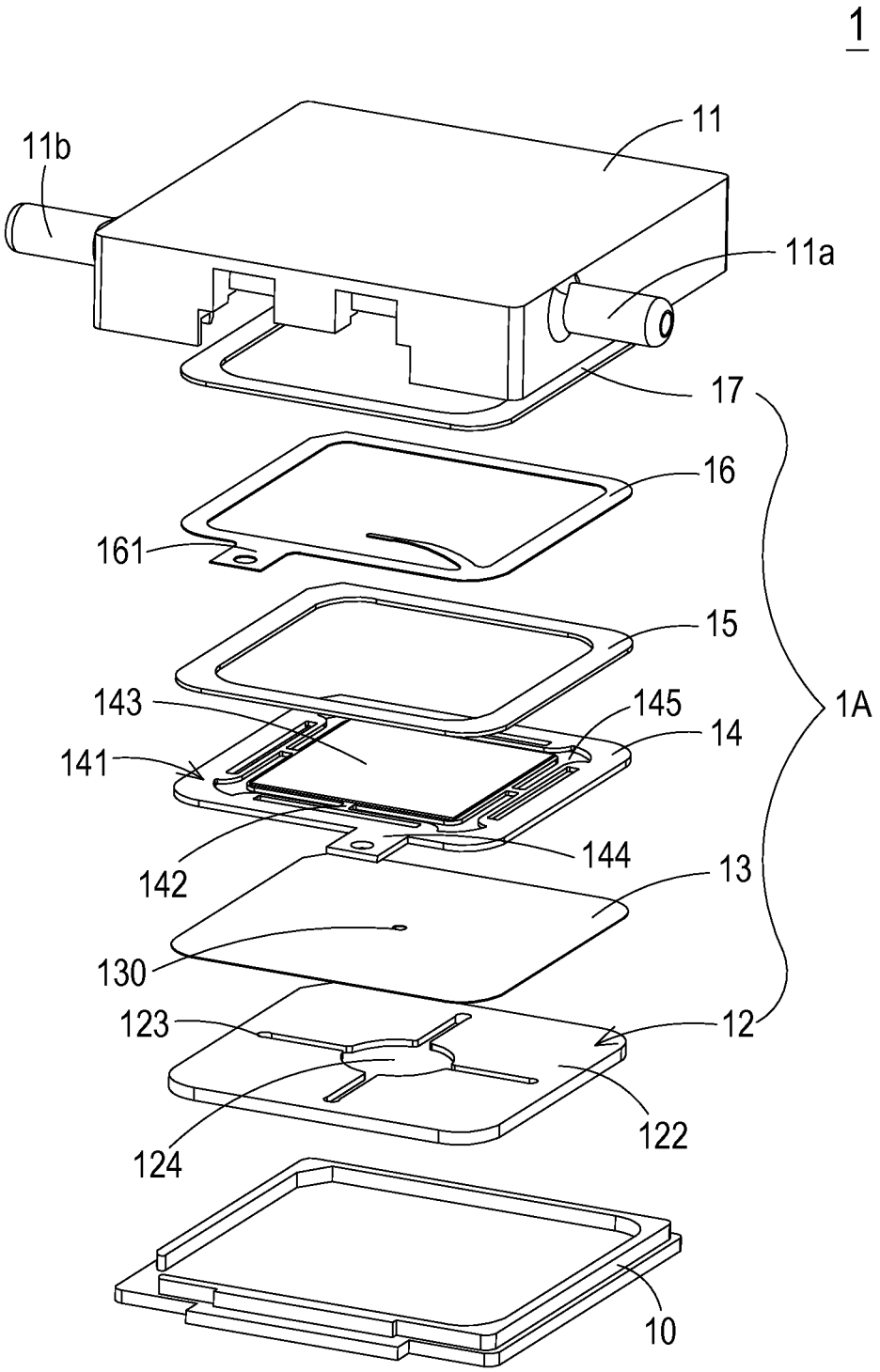
FIG. 1B is a schematic exploded view illustrating the micro-gas pressure driving device according to the first embodiment of the present invention and taken along a rear side.

FIG. 1A is a schematic exploded view illustrating a micro-gas pressure driving device according to a first embodiment of the present invention and taken along a front side. FIG. 1B is a schematic exploded view illustrating the micro-gas pressure driving device according to the first embodiment of the present invention and taken along a rear side. As shown in FIGS. 1A and 1B, the micro-gas pressure driving device 1 comprises a covering plate 10, a miniature gas transportation module 1A and a tube plate 11. In this embodiment, the miniature gas transportation module 1A at least comprises a convergence plate 12, a resonance membrane 13, a piezoelectric actuator 14, a first insulating plate 15, a conducting plate 16 and a second insulating plate 17. The piezoelectric actuator 14 is aligned with the resonance membrane 13. The convergence plate 12, the resonance membrane 13, the piezoelectric actuator 14, the first insulating plate 15, the conducting plate 16 and the second insulating plate 17 are stacked on each other sequentially. In this embodiment, there is a gap g0 between the resonance membrane 13 and the piezoelectric actuator 14 (see FIG. 5A). Alternatively, in some other embodiments, there is no gap between the resonance membrane 13 and the piezoelectric actuator 14. Moreover, the resonance membrane 13 and the piezoelectric actuator 14 can cooperatively generate a resonance effect. In some embodiments, the convergence plate 12 is an integral plate. In some other embodiments, the convergence plate 12 is a combination of a gas inlet plate and a fluid channel plate.

Please refer to FIGS. 1A and 1B again. The convergence plate 12 of the miniature gas transportation module 1A has a first surface 121 and a second surface 122. The first surface 121 and a second surface 122 are opposed to each other. As shown in FIG. 1A, at least one inlet 120 is formed in the first surface 121 of the convergence plate 12. A gas can be introduced into the miniature gas transportation module 1A through the at least one inlet 120. In this embodiment, four inlets 120 are formed in the first surface 121 of the convergence plate 12. It is noted that the number of the inlets 120 may be varied according to the practical requirements. As shown in FIG. 1B, at least one convergence channel 123 and a central opening 124 are formed in the second surface 122 of the convergence plate 12. The at least one convergence channel 123 is in communication with the at least one inlet 120. Since four inlets 120 are formed in the first surface 121 of the convergence plate 12 in this embodiment, four convergence channels 123 are formed in the second surface 122 of the convergence plate 12 and converged to the central opening 124. Consequently, the gas can be transferred downwardly through the central opening 124.

The resonance membrane 13 is made of a flexible material, but is not limited thereto. Moreover, the resonance membrane 13 has a central aperture 130 corresponding to the central opening 124 of the convergence plate 12. Consequently, the gas may be transferred downwardly through the central aperture 130.

Figure 2A:
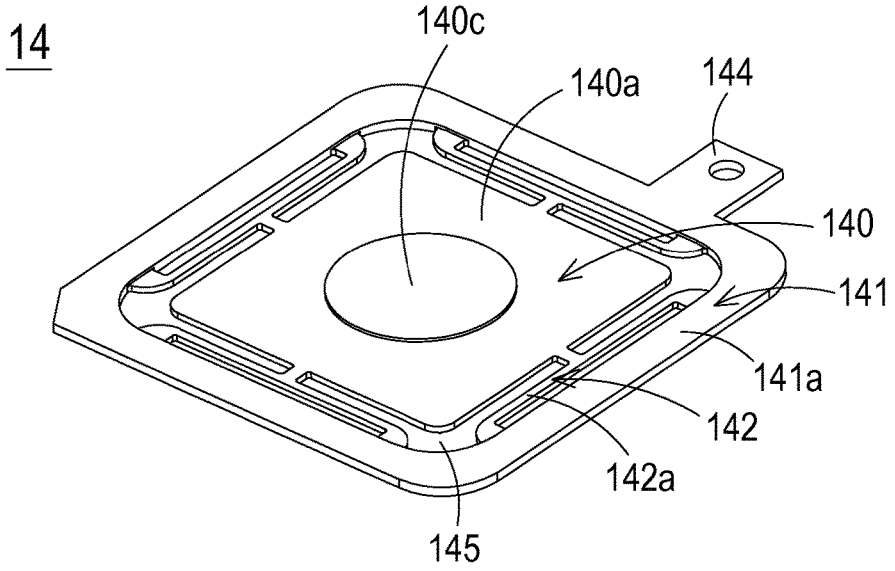
FIG. 2A is a schematic perspective view illustrating the piezoelectric actuator of the micro-gas pressure driving device of FIG. 1A and taken along the front side.
Figure 2B:
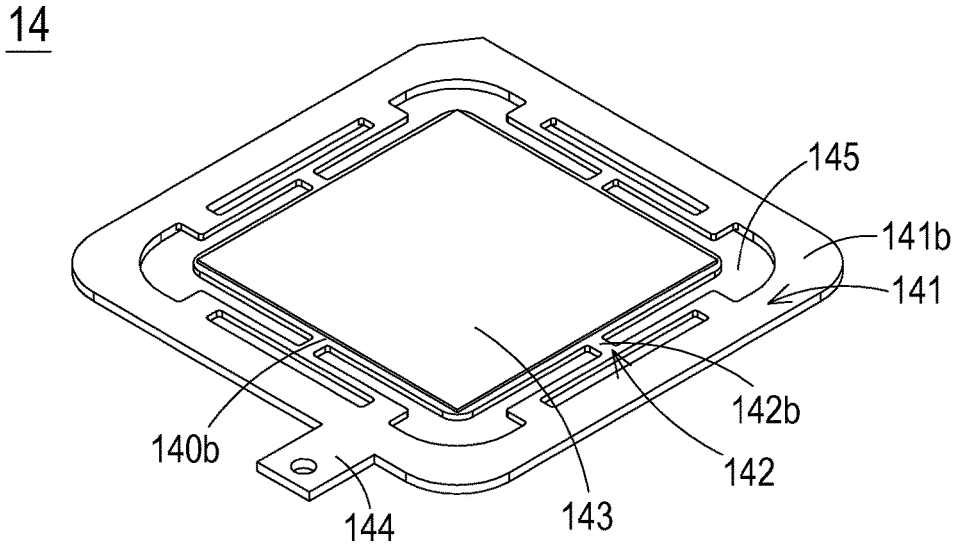
FIG. 2B is a schematic perspective view illustrating the piezoelectric actuator of FIG. 1A and taken along the rear side.

FIG. 2A is a schematic perspective view illustrating the piezoelectric actuator of the micro-gas pressure driving device of FIG. 1A and taken along the front side. FIG. 2B is a schematic perspective view illustrating the piezoelectric actuator of FIG. 1A and taken along the rear side. As shown in FIGS. 2A and 2B, the piezoelectric actuator 140 comprises a suspension plate 140, an outer frame 141, at least one bracket 142, and a piezoelectric ceramic plate 143. The piezoelectric ceramic plate 143 is attached on a bottom surface 140*b* of the suspension plate 140. The at least one bracket 142 is connected between the suspension plate 140 and the outer frame 141. Moreover, at least one vacant space 145 is formed between the bracket 142, the suspension plate 140 and the outer frame 141 for allowing the gas to go through. The type of the outer frame 141 and the type and the number of the at least one bracket 142 and the piezoelectric ceramic plate 143 may be varied according to the practical requirements. Moreover, a conducting pin 144 is protruded outwardly from the outer frame 141 so as to be electrically connected with an external circuit (not shown).

In this embodiment, the suspension plate 140 is a stepped structure. That is, the suspension plate 140 comprises a lower portion 140*a* and an upper portion 140*c*. A top surface of the upper portion 140*c* of the suspension plate 140 is coplanar with a top surface 141*a* of the outer frame 141, and a top surface of the lower portion 140*a* of the suspension plate 140 is coplanar with a top surface 142*a* of the bracket 142. Moreover, the upper portion 140*c* of the suspension plate 140 (or the top surface 141*a* of the outer frame 141) has a specified height with respect to the lower portion 140*a* of the suspension plate 140 (or the top surface 142*a* of the bracket 142). As shown in FIG. 2B, a bottom surface 140*b* of the suspension plate 140, a bottom surface 141*b* of the outer frame 141 and a bottom surface 142*b* of the bracket 142 are coplanar with each other. The piezoelectric ceramic plate 143 is attached on the bottom surface 140*b* of the suspension plate 140. In some embodiments, the suspension plate 140, the bracket 142 and the outer frame 141 are produced by a metal plate. In other words, after the piezoelectric ceramic plate 143 is attached on the metal plate, the piezoelectric actuator 14 is produced.

Figure 3:
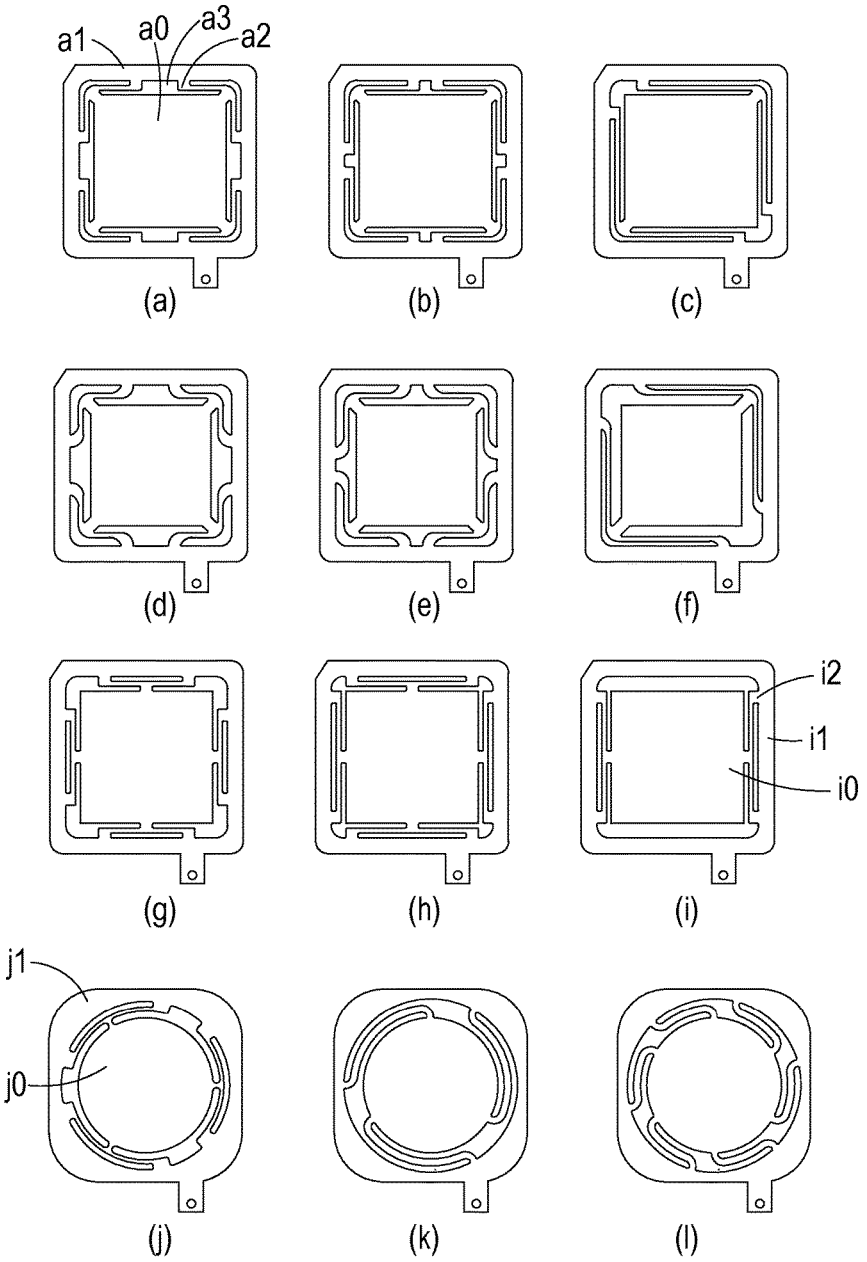
FIG. 3 schematically illustrates various exemplary piezoelectric actuator used in the micro-gas pressure driving device of FIG. 2A.

FIG. 3 schematically illustrates various exemplary piezoelectric actuator used in the micro-gas pressure driving device of FIG. 2A. The suspension plate 140, the outer frame 141 and the at least one bracket 142 of the piezoelectric actuator 14 may have various types. In the type (a), the outer frame a1 and the suspension plate a0 are rectangular, the outer frame a1 and the suspension plate a0 are connected with each other through eight brackets a2, and a vacant space a3 is formed between the brackets a2, the suspension plate a0 and the outer frame a1 for allowing the gas to go through. In the type (i), the outer frame i1 and the suspension plate i0 are also rectangular, but the outer frame i1 and the suspension plate i0 are connected with each other through two brackets i2. In addition, the outer frame and the suspension plate in each of the types (b)~(h) are also rectangular. In each of the types (j)~(l), the suspension plate is circular, and the outer frame has a rectangular with arc-shaped corners. For example, in the type (j), the suspension plate is circular j0, and the outer frame j1 has a rectangular with arc-shaped corners. It is noted that numerous modifications and alterations of the piezoelectric actuator may be made while retaining the teachings of the invention. For example, the suspension plate 140 may be rectangular or circular, and the piezoelectric ceramic plate 143 attached on the bottom surface 140*b* of the suspension plate 140 may be rectangular or circular. Moreover, the number of the brackets between the outer frame and the suspension plate may be varied according to the practical requirements. Moreover, the suspension plate 140, the outer frame 141 and the at least one bracket 142 are integrally formed with each other and produced by a conventional machining process, a photolithography and etching process, a laser machining process, an electroforming process, an electric discharge machining process and so on.

Please refer to FIGS. 1A and 1B again. The miniature gas transportation module 1A further comprises the first insulating plate 15, the conducting plate 16 and the second insulating plate 17. The first insulating plate 15, the conducting plate 16 and the second insulating plate 17 are arranged between the piezoelectric actuator 14 and the tube plate 11. The profiles of the first insulating plate 15, the conducting plate 16 and the second insulating plate 17 are substantially identical to the profile of the outer frame 141 of the piezoelectric actuator 14. The first insulating plate 15 and the second insulating plate 17 are made of an insulating material (e.g. a plastic material) for providing insulating efficacy. In some embodiments, the miniature gas transportation module 1A only comprises a single insulating plate 15 and the conducting plate 16, but the second insulating plate 17 is omitted. The number of the insulating plates may be varied according to the practical requirements. The conducting plate 16 is made of an electrically conductive material (e.g. a metallic material) for providing electrically conducting efficacy. Moreover, the conducting plate 16 has a conducting pin 161 so as to be electrically connected.

Figure 4A:
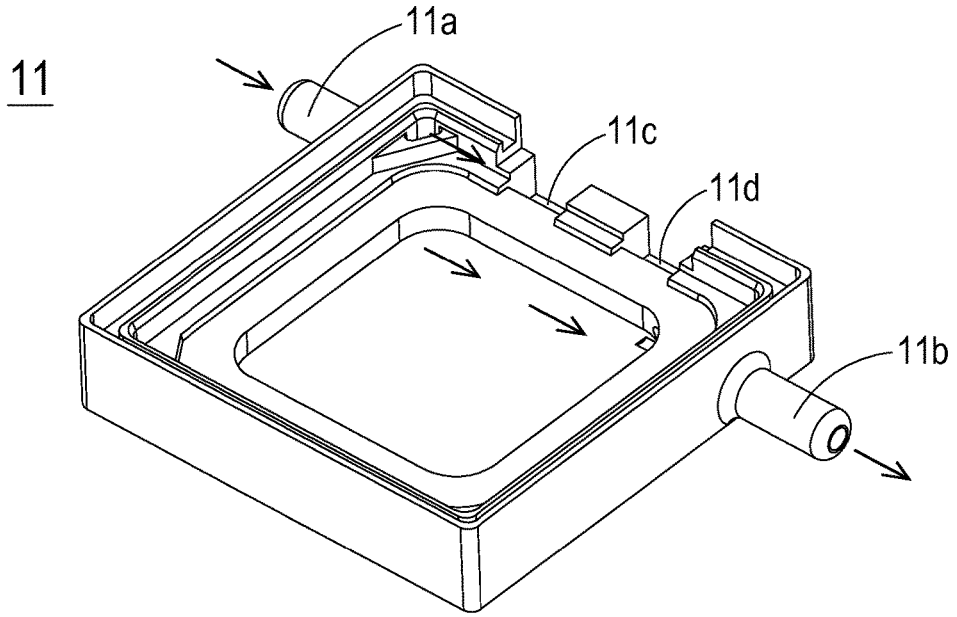
FIG. 4A is a schematic perspective view illustrating the tube plate of the micro-gas pressure driving device of FIG. 1A and taken along the front side.

FIG. 4A is a schematic perspective view illustrating the tube plate of the micro-gas pressure driving device of FIG. 1A and taken along the front side. As shown in FIG. 4A, the tube plate 11 comprises an input tube 11*a* and an output tube 11*b*. A lateral rim of the tube plate 11 further comprises two notches 11*c* and 11*d* corresponding to the conducting pin 144 of the piezoelectric actuator 14 and the conducting pin 161 of the conducting plate 16. Consequently, the conducting pin 144 of the piezoelectric actuator 14 and the conducting pin 161 of the conducting plate 16 are accommodated within the notches 11*c* and 11*d*, respectively. After the covering plate 10, the miniature gas transportation module 1A and the tube plate 11 are combined together, the gas is inputted into the input tube 11*a* of the tube plate 11, then transferred through a first input chamber 111 (see FIG. 6A), a second input chamber 100 (see FIG. 6A), the miniature gas transportation module 1A and an output chamber 112 (see FIG. 6A), and finally outputted from the output tube 11*b*. The first input chamber 111 is located at the junction between the input tube 11*a* of the tube plate 11 and the covering plate 10 (see FIG. 6A). The second input chamber 100 is arranged between the covering plate 10 and the miniature gas transportation module 1A (see FIG. 6A). The output chamber 112 is arranged between the miniature gas transportation module 1A and the tube plate 11 (see FIG. 6A).

Figure 4B:
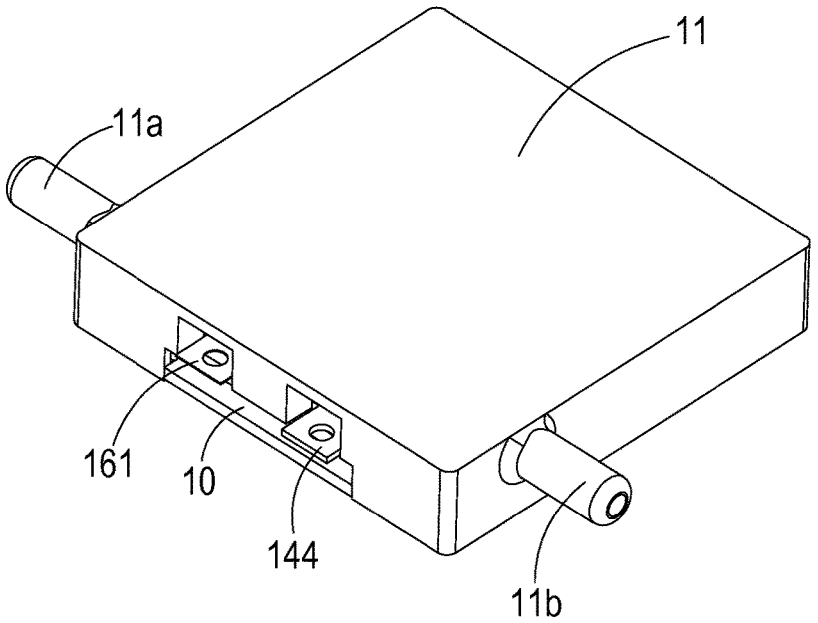
FIG. 4B is a schematic assembled view illustrating the micro-gas pressure driving device of FIG. 1B.

FIG. 4B is a schematic assembled view illustrating the micro-gas pressure driving device of FIG. 1B. After the covering plate 10, the miniature gas transportation module 1A and the tube plate 11 are combined together, the conducting pin 144 of the piezoelectric actuator 14 and the conducting pin 161 of the conducting plate 16 are respectively accommodated within the notches 11*c* and 11*d* and protruded outside the micro-gas pressure driving device 1 so as to be electrically connected with an external circuit (not shown). The covering plate 10 and the tube plate 11 are connected with each other in a sealed manner. Consequently, the gas is inputted into the input tube 11*a* of the tube plate 11, transferred through the miniature gas transportation module 1A and outputted from the output tube 11*b* without leakage.

Figure 5A:
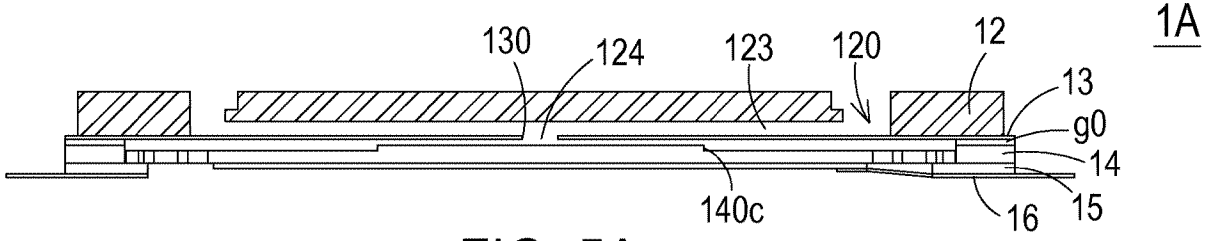
FIGS. 5A~5E schematically illustrate the actions of the miniature gas transportation module of the micro-gas pressure driving device of FIG. 1A.

FIGS. 5A~5E schematically illustrate the actions of the miniature gas transportation module of the micro-gas pressure driving device of FIG. 1A. As shown in FIG. 5A, the convergence plate 12, the resonance membrane 13, the piezoelectric actuator 14, the first insulating plate 15 and the conducting plate 16 of the miniature gas transportation module 1A are stacked on each other sequentially. Moreover, there is a gap g0 between the resonance membrane 13 and the piezoelectric actuator 14. In this embodiment, a filler (e.g. a conductive adhesive) is inserted into the g0 between the resonance membrane 13 and the outer frame 141 of the piezoelectric actuator 14. In other words, the distance between the resonance membrane 13 and the upper portion 140*c* of the suspension plate 140 of the piezoelectric actuator 14 is substantially equal to the height of the gap g0 in order to guide the gas to flow more quickly. Moreover, due to the distance between the resonance membrane 13 and the upper portion 140*c* of the suspension plate 140, the interference between the resonance membrane 13 and the piezoelectric actuator 14 is reduced and the generated noise is largely reduced. In some embodiments, the height of the outer frame 141 of the piezoelectric actuator 14 is increased, so that the gap is formed between the resonance membrane 13 and the piezoelectric actuator 14. In some embodiments, there is no gap between the resonance membrane 13 and the piezoelectric actuator 14.

Please refer to FIGS. 5A~5E again. After the convergence plate 12, the resonance membrane 13 and the piezoelectric actuator 14 are combined together, a cavity for converging the gas is defined by the central opening 124 of the convergence plate 12 and the resonance membrane 13 collaboratively, and a first chamber 131 is formed between the resonance membrane 13 and the piezoelectric actuator 14 for temporarily storing the gas. Through the central aperture 130 of the resonance membrane 13, the first chamber 131 is in communication with the cavity that is defined by the central opening 124 of the convergence plate 12 and the resonance membrane 13. The peripheral regions of the first chamber 131 are in communication with the underlying output chamber 112 (see FIG. 6A) through the vacant space 145 of the piezoelectric actuator 14.

Figure 5B:
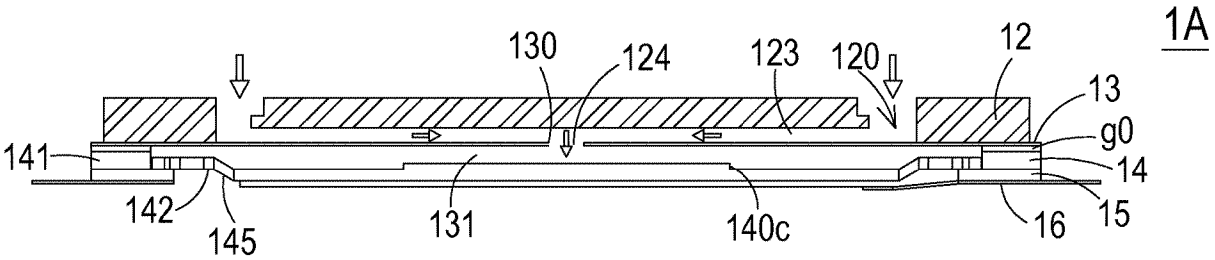

When the miniature gas transportation module 1A of the micro-gas pressure driving device 1 is enabled, the piezoelectric actuator 14 is actuated by an applied voltage. Consequently, the piezoelectric actuator 14 is vibrated along a vertical direction in a reciprocating manner by using the bracket 142 as a fulcrum. As shown in FIG. 5B, the piezoelectric actuator 14 is vibrated downwardly in response to the applied voltage. Consequently, the gas is fed into the at least one inlet 120 of the convergence plate 12. The gas is sequentially converged to the central opening 124 through the at least one convergence channel 123 of the convergence plate 12, transferred through the central aperture 130 of the resonance membrane 13, and introduced downwardly into the first chamber 131.

Figure 5C:
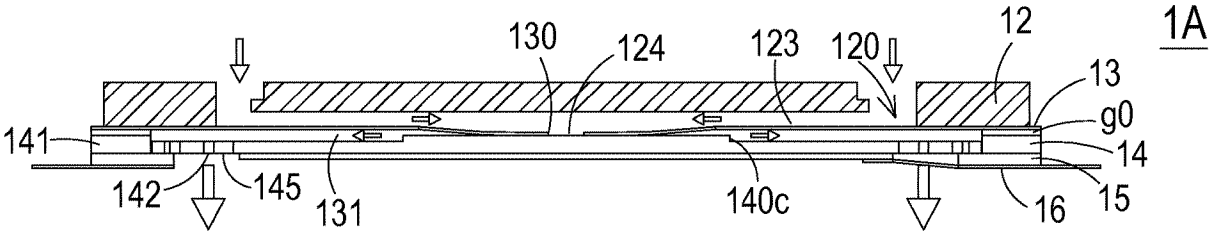

As the piezoelectric actuator 14 is actuated, the resonance of the resonance membrane 13 occurs. Consequently, the resonance membrane 13 is also vibrated along the vertical direction in the reciprocating manner. As shown in FIG. 5C, the resonance membrane 13 is vibrated downwardly and contacted with the upper portion 140*c* of the suspension plate 140 of the piezoelectric actuator 14. Due to the deformation of the resonance membrane 13, the volume of the first chamber 131 is shrunken and the middle communication space of the first chamber 131 is closed. Under this circumstance, the gas is pushed toward peripheral regions of the first chamber 131. Consequently, the gas is transferred downwardly through the vacant space 145 of the piezoelectric actuator 14.

Figure 5D:
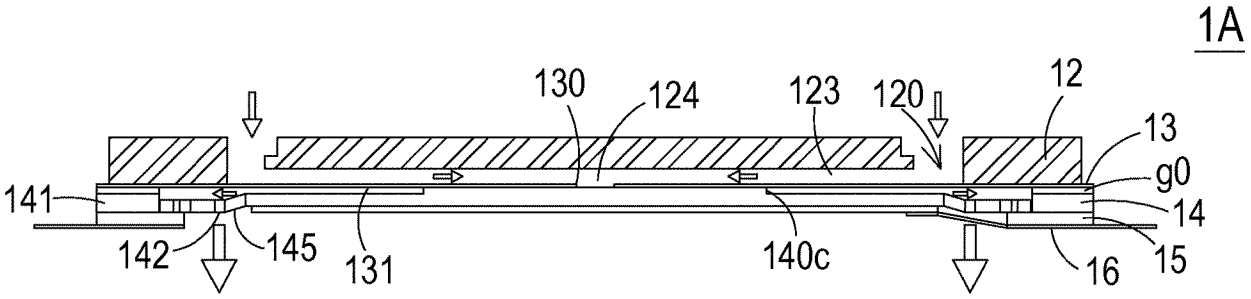

As shown in FIG. 5D, the resonance membrane 13 is returned to its original position, and the piezoelectric actuator 14 is vibrated upwardly in response to the applied voltage. Consequently, the volume of the first chamber 131 is also shrunken. Since the piezoelectric actuator 14 is ascended, the gas is continuously pushed toward peripheral regions of the first chamber 131. Meanwhile, the gas is continuously fed into the at least one inlet 120 of the convergence plate 12, and transferred to the central opening 124 of the convergence plate 12.

Figure 5E:
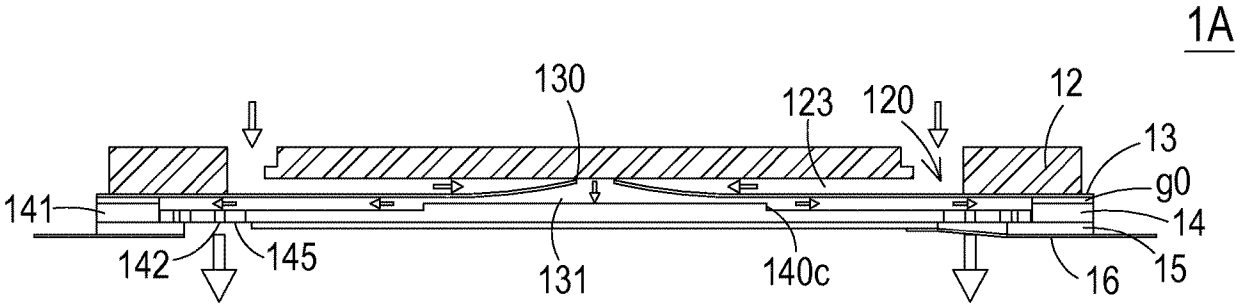

Then, as shown in FIG. 5E, the resonance of the resonance membrane 13 occurs. Consequently, the resonance membrane 13 is vibrated upwardly. Under this circumstance, the gas in the central opening 124 of the convergence plate 12 is transferred to the first chamber 131 through the central aperture 130 of the resonance membrane 13, then the gas is transferred downwardly through the vacant space 145 of the piezoelectric actuator 14, and finally the gas is exited from the miniature gas transportation module 1A.

From the above discussions, when the resonance membrane 13 is vibrated along the vertical direction in the reciprocating manner, the gap g0 between the resonance membrane 13 and the piezoelectric actuator 14 is helpful to increase the amplitude of the resonance membrane 13. That is, due to the gap g0 between the resonance membrane 13 and the piezoelectric actuator 14, the amplitude of the resonance membrane 13 is increased when the resonance occurs. Consequently, a pressure gradient is generated in the fluid channels of the miniature gas transportation module 1A to facilitate the gas to flow at a high speed. Moreover, since there is an impedance difference between the feeding direction and the exiting direction, the gas can be transmitted from the inlet side to the outlet side. Moreover, even if the outlet side has a gas pressure, the miniature gas transportation module 1A still has the capability of pushing out the gas.

In some embodiments, the vibration frequency of the resonance membrane 13 along the vertical direction in the reciprocating manner is identical to the vibration frequency of the piezoelectric actuator 14. That is, the resonance membrane 13 and the piezoelectric actuator 14 are synchronously vibrated along the upward direction or the downward direction. It is noted that numerous modifications and alterations of the actions of the miniature gas transportation module 1A may be made while retaining the teachings of the invention.

Figure 6A:
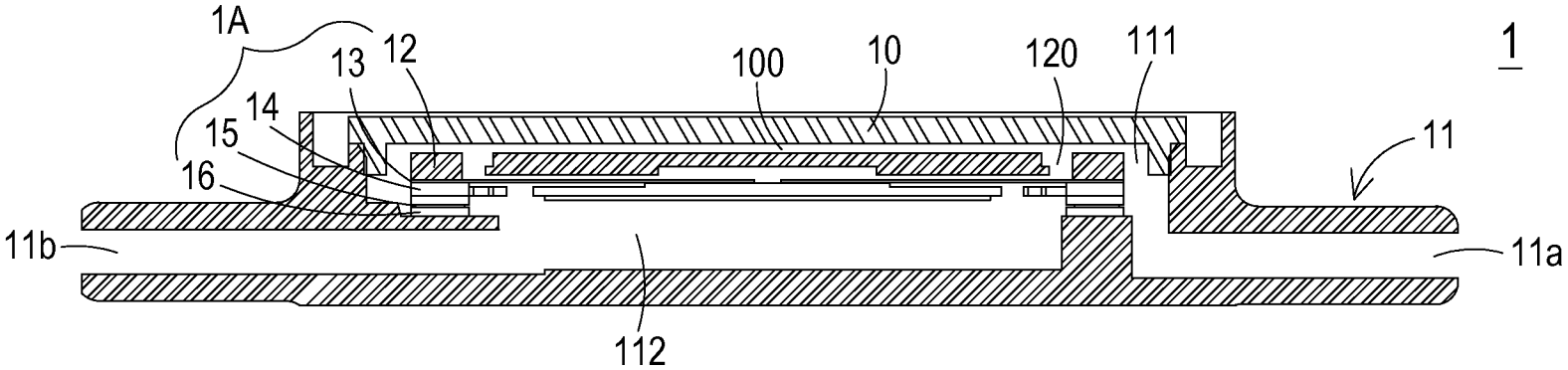
FIG. 6A is a schematic assembled view illustrating the micro-gas pressure driving device of FIG. 1A.
Figure 6B:
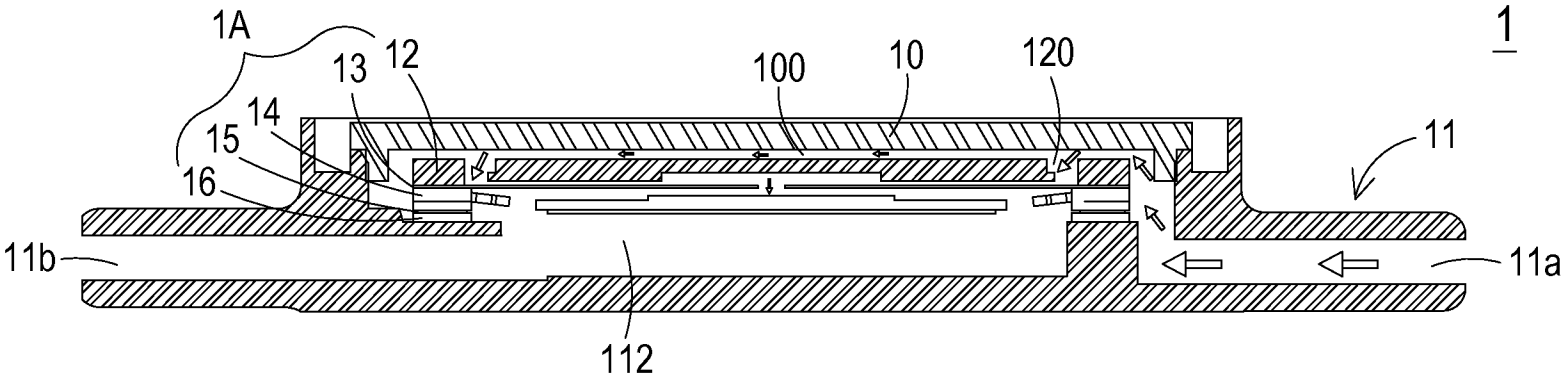
FIGS. 6B~6D schematically illustrate the actions of the micro-gas pressure driving device of FIG. 1A.
Figure 6C:
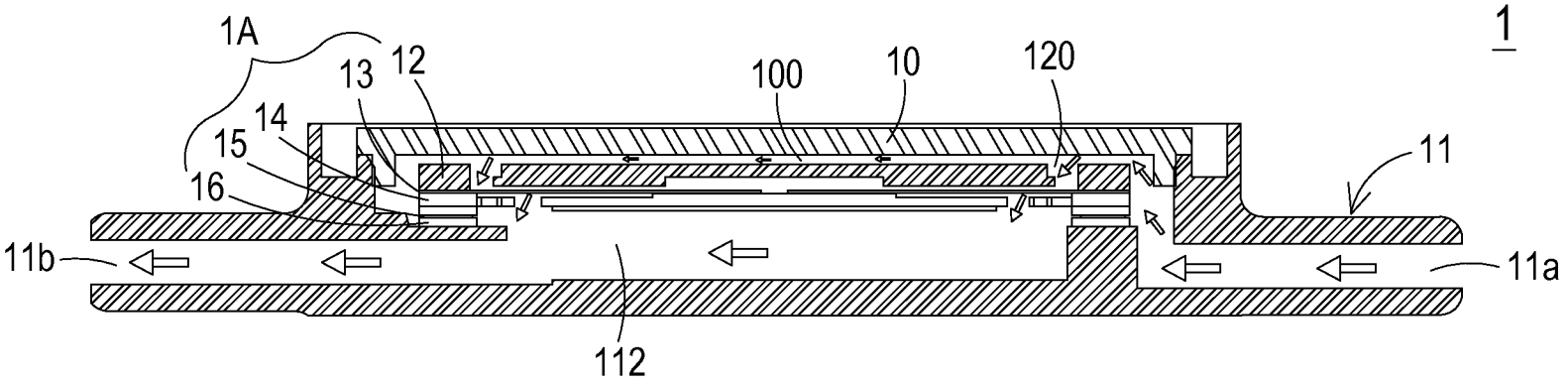
Figure 6D:
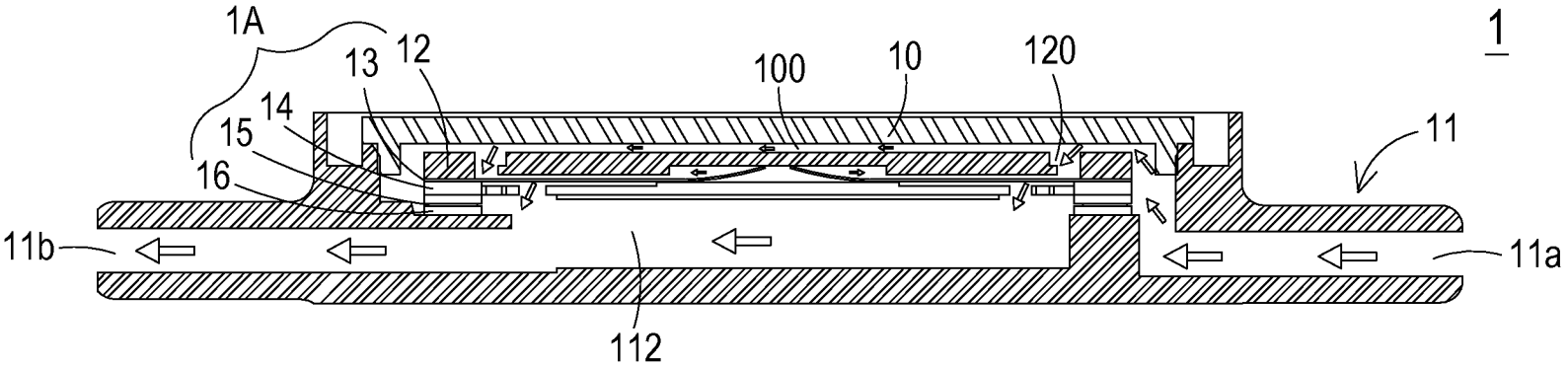

FIG. 6A is a schematic assembled view illustrating the micro-gas pressure driving device of FIG. 1A. FIGS. 6B~6D schematically illustrate the actions of the micro-gas pressure driving device of FIG. 1A.

Please refer to FIG. 1A. After the covering plate 10, the miniature gas transportation module 1A and the tube plate 11 are combined together, a first input chamber 111 is located at the junction between the covering plate 10 and the input tube 11*a* of the tube plate 11, a second input chamber 100 is defined between the covering plate 10 and the convergence plate 12 of the miniature gas transportation module 1A, and an output chamber 112 is defined between the tube plate 11 and the piezoelectric actuator 14 of the miniature gas transportation module 1A.

Please refer to FIG. 6B. When the piezoelectric actuator 14 of the miniature gas transportation module 1A is actuated, a negative pressure is generated, and thus the gas is inhaled into the input tube 11*a* of the tube plate 11. Along the path indicated by the arrows, the gas is subsequently transferred through the first input chamber 111 (i.e., at the junction between the covering plate 10 and the input tube 11*a* of the tube plate 11), the second input chamber 100 (i.e., between the covering plate 10 and the convergence plate 12), the at least one inlet 120 of the convergence plate 12, the at least one convergence channel 123 of the convergence plate 12, the central opening 124 of the convergence plate 12 and the central aperture 130 of the resonance membrane 13.

Then, please refer to FIG. 6C. After the gas is transferred through the vacant space 145 of the piezoelectric actuator 14, the gas is exited from the miniature gas transportation module 1A. Then, the gas is transferred to the output chamber 112 (i.e., between the tube plate 11 and the piezoelectric actuator 14) and outputted from the output tube 11*b* of the tube plate 11.

Then, please refer to FIG. 6D. Due to the resonance of the resonance membrane 13, the resonance membrane 13 is vibrated upwardly. Under this circumstance, the gas in the central opening 124 of the convergence plate 12 is transferred to the first chamber 131 through the central aperture 130 of the resonance membrane 13 (see also FIG. 5E), then the gas is transferred downwardly through the vacant space 145 of the piezoelectric actuator 14, and finally the gas is transferred to the output chamber 112. As the gas pressure is continuously increased along the downward direction, the gas is continuously transferred along the downward direction and outputted from the output tube 11*b* of the tube plate 11. Consequently, the pressure of the gas is accumulated to any container that is connected with the outlet end.

Figure 7A:
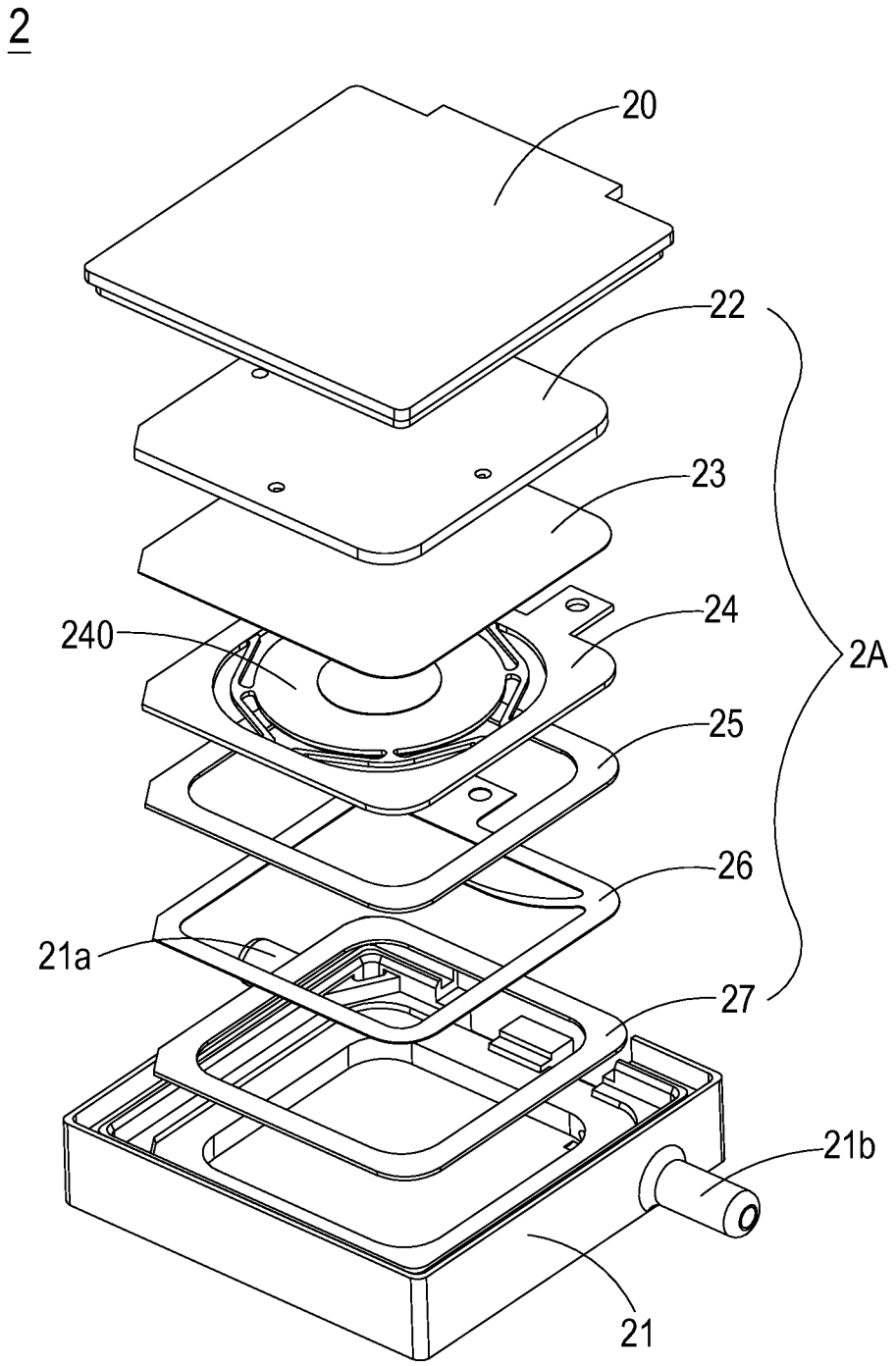
FIG. 7A is a schematic exploded view illustrating a micro-gas pressure driving device according to a second embodiment of the present invention and taken along a front side.
Figure 7B:
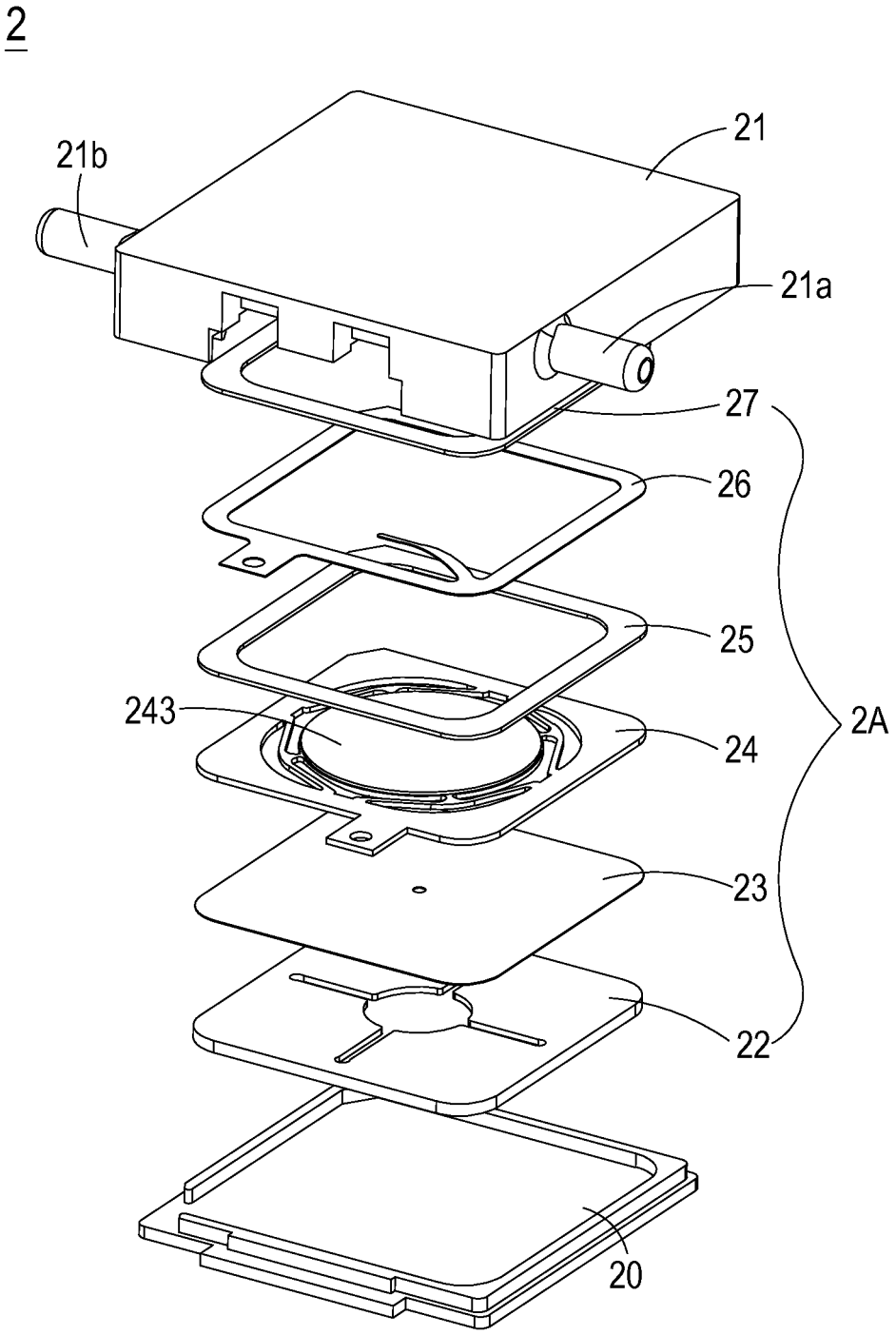
FIG. 7B is a schematic exploded view illustrating the micro-gas pressure driving device according to the second embodiment of the present invention and taken along a rear side.
Figure 8:
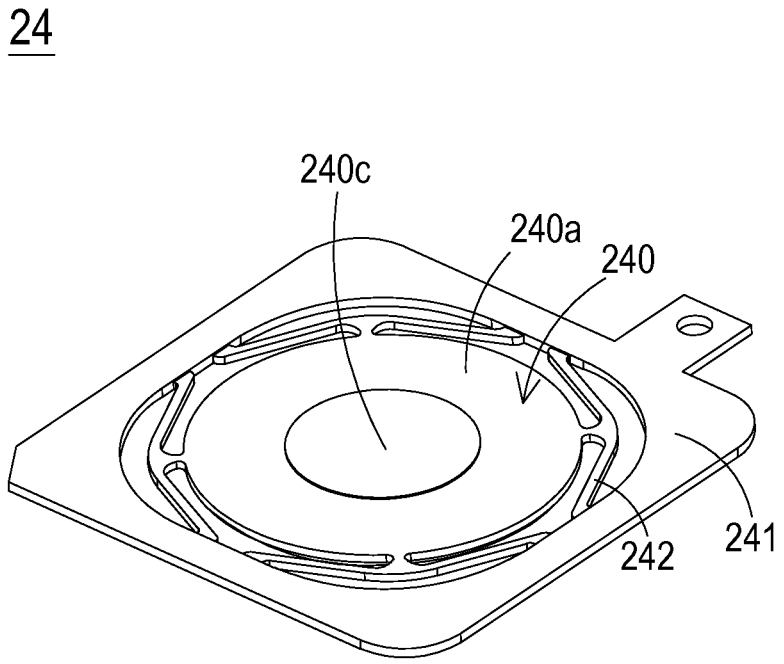
FIG. 8 schematically illustrates an exemplary piezoelectric actuator used in the micro-gas pressure driving device of FIG. 7A.

FIG. 7A is a schematic exploded view illustrating a micro-gas pressure driving device according to a second embodiment of the present invention and taken along a front side. FIG. 7B is a schematic exploded view illustrating the micro-gas pressure driving device according to the second embodiment of the present invention and taken along a rear side. FIG. 8 schematically illustrates an exemplary piezoelectric actuator used in the micro-gas pressure driving device of FIG. 7A. As shown in FIGS. 7A, 7B and 8, the micro-gas pressure driving device 2 comprises a covering plate 20, a miniature gas transportation module 2A and a tube plate 21. In this embodiment, the miniature gas transportation module 2A comprises a convergence plate 22, a resonance membrane 23, a piezoelectric actuator 24, a first insulating plate 25, a conducting plate 26 and a second insulating plate 27. The piezoelectric actuator 24 is aligned with the resonance membrane 23. The convergence plate 22, the resonance membrane 23, the piezoelectric actuator 24, the first insulating plate 25, the conducting plate 26 and the second insulating plate 27 are stacked on each other sequentially. The covering plate 20 and the tube plate 21 are connected with each other in a sealed manner. A first input chamber (not shown) is located at the junction between the covering plate 20 and the input tube 21*a* of the tube plate 21, a second input chamber (not shown) is defined between the covering plate 20 and the convergence plate 22 of the miniature gas transportation module 2A, and an output chamber (not shown) is defined between the tube plate 21 and the piezoelectric actuator 24 of the miniature gas transportation module 2A. When the piezoelectric actuator 24 of the miniature gas transportation module 2A is activated to feed a gas into the input tube 21*a* of the tube plate 21, the gas is sequentially transferred through the first input chamber, the second input chamber, the convergence plate and the resonance membrane 23, and transferred downwardly through the piezoelectric actuator 24 and the output chamber, and outputted from the output tube 21*b* of the tube plate 21. The structures, arrangements and functions of the convergence plate 22, the resonance membrane 23, the piezoelectric actuator 24, the first insulating plate 25 and the conducting plate 26 are similar to those of the first embodiment, and are not redundantly described herein.

In comparison with the first embodiment, the structure of the piezoelectric actuator 24 of this embodiment is slightly distinguished. As shown in FIG. 8, the piezoelectric actuator 240 comprises a suspension plate 240, an outer frame 241, at least one bracket 242, and a piezoelectric ceramic plate 243 (see FIG. 7B). The piezoelectric ceramic plate 243 is attached on a bottom surface 240*b* of the suspension plate 240. The at least one bracket 242 is connected between the suspension plate 240 and the outer frame 241. In this embodiment, the suspension plate 240 has a circular shape. Moreover, the suspension plate 240 comprises a lower portion 240*a* and an upper portion 240*c*. The upper portion 240*c* also has a circular shape, but is not limited thereto. Since the suspension plate 240 of the piezoelectric actuator 24 has the circular shape, the piezoelectric ceramic plate 243 also has the circular shape. In other words, the piezoelectric actuator 24 may have various shaped.

From the above descriptions, the present invention provides the micro-gas pressure driving device. The micro-gas pressure driving device comprises the covering plate, the tube plate and the miniature gas transportation module. After the covering plate, the miniature gas transportation module and the tube plate are combined together, the gas is inputted into the miniature gas transportation module through the input tube of the tube plate. Then, the gas is sequentially transferred through the first input chamber (i.e., at the junction between the covering plate and the input tube of the tube plate), the second input chamber (i.e., between the covering plate and the convergence plate), the at least one inlet of the convergence plate, the at least one convergence channel of the convergence plate, the central opening of the convergence plate and the central aperture of the resonance membrane, and transferred downwardly through the piezoelectric actuator and the output chamber, and outputted from the output tube of the tube plate. When the piezoelectric actuator is activated, a pressure gradient is generated in the fluid channels and the chambers of the miniature gas transportation module to facilitate the gas to flow at a high speed. By the micro-gas pressure driving device of the present invention, the gas can be quickly transferred while achieving silent efficacy. Moreover, the micro-gas pressure driving device of the present invention has small volume and small thickness. Consequently, the micro-gas pressure driving device is portable and applied to medical equipment or any other appropriate equipment. In other words, the micro-gas pressure driving device of the present invention has industrial values.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A micro-gas pressure driving device, comprising:

a gas transportation module comprising a convergence plate, a resonance membrane and a piezoelectric actuator, wherein at least one inlet is formed in a first surface of the convergence plate, at least one convergence channel and a central opening are formed in a second surface of the convergence plate, and the at least one convergence channel is in communication with the at least one inlet, wherein the resonance membrane has a central aperture corresponding to the central opening of the convergence plate, wherein the convergence plate, the resonance membrane and the piezoelectric actuator are stacked on each other sequentially;

a covering plate disposed over the convergence plate of the gas transportation module; and a tube plate disposed under the piezoelectric actuator of the gas transportation module, and comprising an input tube and an output tube, wherein a first input chamber is located at a junction between the covering plate and the tube plate, a second input chamber is defined between the covering plate and the convergence plate of the gas transportation module, and an output chamber is defined between the tube plate and the piezoelectric actuator of the gas transportation module, wherein when the gas transportation module is activated to feed a gas into the input tube of the tube plate, the gas is sequentially transferred through the first input chamber, the second input chamber, the at least one inlet of the convergence plate, the at least one convergence channel of the convergence plate, the central opening of the convergence plate and the central aperture of the resonance membrane, and transferred through a vacant space of the piezoelectric actuator and the output chamber, and outputted from the output tube of the tube plate.

2. The micro-gas pressure driving device according to claim 1, wherein the piezoelectric actuator comprises a suspension plate, an outer frame and a piezoelectric ceramic plate, wherein the suspension plate and the outer frame are connected with each other through at least one bracket, and the piezoelectric ceramic plate is attached on a surface of the suspension plate.

3. The micro-gas pressure driving device according to claim 2, wherein the suspension plate of the piezoelectric actuator is a stepped structure including a lower portion and an upper portion, wherein a top surface of the upper portion is coplanar with a top surface of the outer frame, wherein the upper portion of the suspension plate or the top surface of the outer frame has a specified height with respect to the lower portion of the suspension plate or a surface of the at least one bracket.

4. The micro-gas pressure driving device according to claim 2, wherein the piezoelectric ceramic plate of the piezoelectric actuator of the gas transportation module is attached on a bottom surface of the suspension plate, wherein the bottom surface of the suspension plate, a bottom surface of the outer frame and a bottom surface of the at least one bracket are coplanar with each other.

5. The micro-gas pressure driving device according to claim 2, wherein the suspension plate, the outer frame and the at least one bracket are integrally formed with each other, and made of a metallic material.

6. The micro-gas pressure driving device according to claim 1, wherein the gas transportation module further comprises at least one insulating plate and at least one conducting plate, wherein the at least one insulating plate and the at least one conducting plate are disposed under the piezoelectric actuator.

7. The micro-gas pressure driving device according to claim 1, wherein the resonance membrane is made of a flexible material, wherein the resonance membrane and the piezoelectric actuator cooperatively generate a resonance effect.

8. The micro-gas pressure driving device according to claim 1, wherein the resonance membrane and the piezoelectric actuator of the gas transportation module are separated from each other by a gap, so that a first chamber is defined between the resonance membrane and the piezoelectric actuator, wherein after the gas is transferred through the at least one inlet of the convergence plate, the gas is sequentially transferred through the at least one convergence channel of the convergence plate, the central opening of the convergence plate, the central aperture of the resonance membrane and the first chamber, and transferred through the vacant space of the piezoelectric actuator.

9. The micro-gas pressure driving device according to claim 1, wherein the convergence plate comprises a first surface and a second surface, wherein the at least one inlet is formed in the first surface, and the at least one convergence channel and the central opening are formed in the second surface, wherein the at least one convergence channel of second surface is in communication with the corresponding inlet of the first surface.

* * * * *